US009984595B2

(12) United States Patent
Snow et al.

(10) Patent No.: US 9,984,595 B2
(45) Date of Patent: May 29, 2018

(54) SECURITY STICKER AND METHOD FOR BANKING CARDS

(71) Applicants: Joanne M. Snow, Rockford, IL (US); Raymond J. Snow, Rockford, IL (US); Susan S. Polachek, Barrington, IL (US)

(72) Inventors: Joanne M. Snow, Rockford, IL (US); Raymond J. Snow, Rockford, IL (US); Susan S. Polachek, Barrington, IL (US)

( * ) Notice: Subject to any disclaimer, the term of this patent is extended or adjusted under 35 U.S.C. 154(b) by 75 days.

(21) Appl. No.: 14/488,606

(22) Filed: Sep. 17, 2014

(65) Prior Publication Data

US 2015/0079326 A1 Mar. 19, 2015

Related U.S. Application Data

(60) Provisional application No. 61/878,957, filed on Sep. 17, 2013.

(51) Int. Cl.
*G09F 3/03* (2006.01)
*G09F 3/02* (2006.01)
(Continued)

(52) U.S. Cl.
CPC ..... *G09F 3/0341* (2013.01); *G09F 3/02* (2013.01); *G09F 3/0292* (2013.01); *G09F 3/10* (2013.01);
(Continued)

(58) Field of Classification Search
CPC ..... Y10T 428/14; Y10T 428/1486; G09F 3/0292; G09F 3/0341; G09F 3/10;
(Continued)

(56) References Cited

U.S. PATENT DOCUMENTS 3,594,933 A 7/1971 Cooper
4,017,994 A 4/1977 Fraser
(Continued)

FOREIGN PATENT DOCUMENTS

DE 19716099 10/1998
EP 0793211 9/1997

OTHER PUBLICATIONS

Avery Dennison, "2013 Online Product Summary," Mar. 2013, p. 30.
Avery Dennison, "Fasson EXACT Update," Jun. 2016, p. 6.

*Primary Examiner* — Patricia L. Nordmeyer
(74) *Attorney, Agent, or Firm* — Mercedes V. O'Connor; Rockman Videbeck & O'Connor

(57) ABSTRACT

The security sticker and method for banking cards includes security stickers that provide protection of information displayed on cards, by allowing users to apply an adhesive backed, tamper evident, camouflaged sticker over any information the user wishes to protect. Different embodiments of the security stickers are provided for users having different kinds of banking cards. An adhesive sticker kit for banking cards includes at least two adhesive stickers to cover the front and back of the bank account numbers displayed on the cards, at least one sticker of different size covering the security code of the cards, another sticker advising to "Check Photo ID" of user, and at least one sticker displays account information protection advisory statements. The security sticker substrate has a top layer that will crack if someone attempts to remove the sticker from the card, thereby alerting the cardholder that someone has tampered with the banking card.

20 Claims, 3 Drawing Sheets

(51) Int. Cl.
*G09F 3/10* (2006.01)
*G09F 3/00* (2006.01)

(52) U.S. Cl.
CPC ..... *G09F 2003/0208* (2013.01); *G09F 2003/0241* (2013.01); *G09F 2003/0257* (2013.01); *G09F 2003/0277* (2013.01); *G09F 2003/0279* (2013.01); *Y10T 428/14* (2015.01); *Y10T 428/1486* (2015.01)

(58) Field of Classification Search
CPC ..... G09F 3/02; G09F 2003/0208; G09F 2003/0241; G09F 2003/0257; G09F 2003/0277; G09F 2003/0279
See application file for complete search history.

(56) References Cited

U.S. PATENT DOCUMENTS 5,153,042 A * 10/1992 Indrelie ..... G09F 3/0292 283/72
5,277,971 A 1/1994 Weng et al.
5,399,021 A 3/1995 Litt
5,605,738 A 2/1997 McGinness et al.
6,372,341 B1 4/2002 Jung et al.
6,562,429 B2 5/2003 Aoki et al.
6,752,430 B2 6/2004 Holt et al.
7,055,273 B2 6/2006 Roshkoff
8,302,858 B2 11/2012 Eng
2005/0230960 A1 * 10/2005 Bilodeau ..... G09F 3/0292 283/75
2006/0077287 A1 * 4/2006 Koshu ..... G09F 3/0292 348/376
2006/0124574 A1 * 6/2006 Yousif ..... B65D 41/045 215/232
2007/0110964 A1 5/2007 Beier et al.
2007/0126226 A1 6/2007 Kolodzie et al.
2009/0260731 A1 10/2009 Roth et al.
2009/0324907 A1 12/2009 D'Amato et al.
2012/0200077 A1 8/2012 Pohlman
2012/0234481 A1 9/2012 Raming
2013/0037615 A1 2/2013 Powell et al.
2013/0068366 A1 3/2013 Eng

* cited by examiner

36

Gaurd Against
Credit/Debit Card Fraud By
Anyone Handling Your Cards!

Tamper Evident Protection Against Unauthorized Use
While Using Your Credit/Debit Card Outside The Home Sticker Set For Two Credit/Debit Cards Additional Stickers: www.cardalertsstickers.com Directions to apply the adhesive stickers 1. Apply and firmly press the first "Only to be Removed by Cardholder" sticker over the first 12 digits of the card number on the front of your credit/debit card, leaving the last four digits visible. If applicable, on the back side of the card place the second "Only To Be Removed By Cardholder" sticker over the same recessed 12 digits of the card number.

2. Apply the "Check Photo ID" sticker over the signature strip on the back of the card.

3. Apply the "Do Not Remove" sticker over the security code on the card.

4. INSPECT THE CARD AFTER EVERY TRANSACTION FOR TAMPER EVIDENCE.

5. CARD ALERT STICKERS may be removed by the cardholder, if needed.

NOTE: PRODUCT IS INTENDED TO ALERT CARDHOLDER WHEN CARD IS TAMPERED WITH. PRODUCT WILL NOT DETER ALL TYPES OF CREDIT/DEBIT CARD FRAUD OR IDENTITY THEFT.

It is recommended that cardholder record their card number and security code in a secure place at home.

Card Alert Sticker. LLC
*Patent Pending 8 5 199 0000 2

**When CARD ALERT STICKERS are removed some residue may remain, which may be removed with adhesive remover.

30

FIG. 4

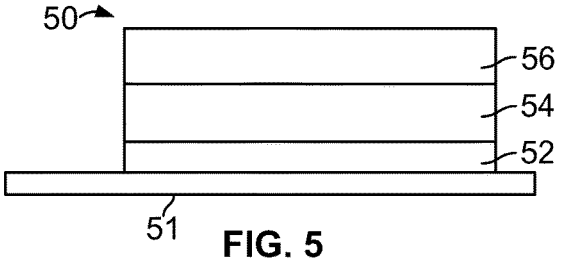

FIG. 5

SECURITY STICKER AND METHOD FOR BANKING CARDS

This application claims priority to provisional application Ser. No. 61/878,957 filed Sep. 17, 2013 to the extent allowed by law.

BACKGROUND OF THE INVENTION

Field of the Invention

The present invention relates to consumer credit and debit account information security. More particularly, the invention relates to banking card security utilizing adhesive stickers to cover the personal information on a banking card to effectively deal with the hazards of the theft of banking card information.

Background of the Invention

Credit cards, debit cards, or other forms of banking cards bearing personal and account information on the cards can become a source of identity information leaking and eventually lead to credit card fraud activities. According to the Federal Trade Commission, identity theft activities increased 21 percent in 2008. Although incidents of credit card fraud is limited to under 1% of all card transactions, this conduct has resulted in huge multi-billion dollar financial losses and has been reported as being one of the key concerns of consumers. The industry-wide cost of bank card fraud in 2006 was 9 cents per 100 dollars worth of transactions.

A legitimate transaction to a merchant may lead to bank card fraud. The data associated with the user's account, including the card account number or other information that would routinely and necessarily be available can be compromised during a legitimate transaction, especially when the victim's card is taken outside of the cardholder's immediate view. Common scenarios of these compromises can occur in a restaurant, bar, or other retail establishments, as well as hidden devices that secretly record the account information while the card is being scanned at the checkout or at an ATM machine, and that can usually be conducted without tipping off the cardholder, the merchant or the issuer, at least until the account is ultimately used for fraud.

Various prior art patents and patent applications are directed to efforts to resolve this question. U.S. Pat. No. 8,302,858 discloses a method and system for protecting credit card account information. The disclosed system provides a credit card with a card portion displaying a first part of an account number and an electronically readable region. The credit card may also include a sleeve portion that holds the card portion and that may display a second part of an account number.

Published Patent Application No. 20090260731 discloses a smart cardholder or passport holder having two sides sealed together at three edges to leave an interior space dimensioned and configured to hold a smart card or passport. The holder sides have multiple layers, one of the layers protecting any magnetic strip on a card or the like from the dielectric material and preventing unauthorized RF remote access to the smart card chip or passport chip.

Another published Patent Application No. 20130037615 discloses a card cover that encapsulates the account numbers on a credit card, debit card, gas card, or general bank card to conceal the information for security purposes. This application discloses guard bands removable by the owner, yet reveals when someone else has tampered or attempted to tamper with the bands. These guards are designed in such a way that once removed they cannot be reaffixed to the card.

An air sensitive material is layered above the adhesive to allow the cardholder to detect the change of color of the card guard when the card is compromised. The material has a clear covering allowing the material to be protected from air on top of the card, and allowing the user to see the change in color should the card be tampered with.

Despite all the teachings from the prior art references, there lacks a method or system that properly protects both embossed and non-embossed account numbers on a credit card, or instructs a sales person to check "ID", produces a cracking to demonstrate to the cardholder that the covering layer has been removed or tampered with, and carries personalized information for the cardholder to select and provide additional aesthetic value to the user's card.

SUMMARY OF THE INVENTION

The present invention prevents a waiter, clerk or the like, from knowing what the user's card number is by allowing the user to apply an adhesive backed, tamper evident and opaque sticker over all but the last four numbers of the user's card on the front, and over all or most of the digits on the back of the card. The present invention contemplates that a similar sticker can be applied to cover the card code number on either the front or rear of the card. Each strip is adhesive backed and opaque.

In one embodiment the sticker covering the protruding side of the embossed numbers on the card has a predetermined thickness to form a cushion. This cushion properly protects the protruding account number from being revealed without removing the covering sticker. The sticker covering the recessing side of the embossed numbers is the same thickness as the front covering sticker but also has a cushion to protect the numbers as well.

In another embodiment of the invention, the tamper evident sticker is adapted to be placed over a card number printed, but not embossed on the card. In a further embodiment, a plurality of tamper evident stickers are packaged and sold as a kit for ease of purchase and use by a cardholder.

BRIEF DESCRIPTION OF THE DRAWINGS

The features of the present invention which are believed to be novel are set forth with particularity in the appended claims. The invention may best be understood from the following detailed description of currently illustrated embodiments thereof taken in conjunction with the accompanying drawings wherein like numerals refer to like parts, and in which:

FIG. 4 is a rear elevation view of the embodiment of an adhesive security sticker kit of FIG. 3, with instructions to apply the security stickers.

FIG. 5 is an enlarged cross sectional view of the three layered security sticker embodiment of the present invention applied on a banking card.

DETAILED DESCRIPTION OF THE ILLUSTRATED EMBODIMENTS

Figure 1:
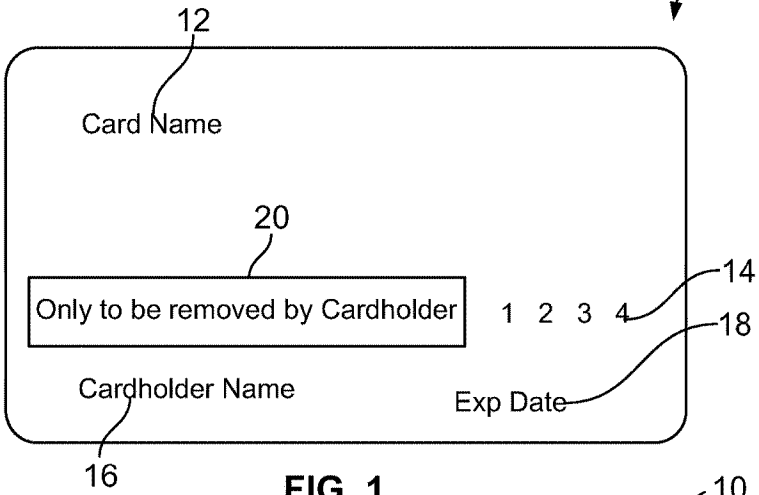
FIG. 1 is a front elevation view of one embodiment of an adhesive security sticker applied on the front of a banking card in accordance with the present invention.
Figure 2:
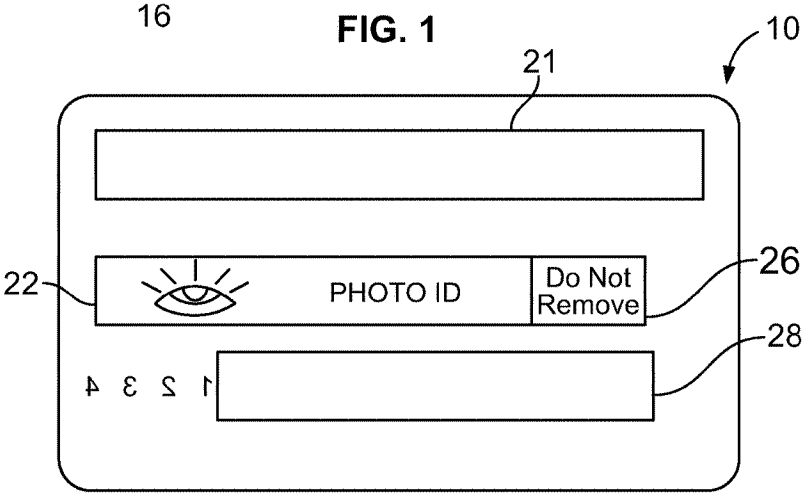
FIG. 2 is a rear elevation view of one embodiment of three adhesive security stickers applied on the back of the banking card of FIG. 1.

As shown in FIGS. 1-2, the front and back of a banking card 10 displays certain user account information. The information includes, but is not limited to the name of the card or issuing bank 12, the account number 14 normally sixteen digits, the cardholder's name 16, and the expiration date 18 of the card. The security sticker 20 of the present invention, which includes a camouflaged surface, is shown applied over a portion of the displayed numbers 14 on the banking card 10 to at least partially conceal the account number 14 on the banking card 10, making it difficult to discern the numbers underneath.

In the illustrated embodiment shown in FIG. 1, the security sticker 20 is placed over the first 12-digits of the 16-digit banking card number located on the front of the banking card 10. The last four digits of the banking account number 14 are exposed for card verification with receipt. The security sticker 20 is applied only to appropriately cover the selected numbers on the card, but does not interfere with the swiping process. This is because usually the electronic swipe band 21 is on the backside and at the top end of the banking card 10 (FIG. 2). The security sticker 20 has a thin cushion that allows the banking card to fit and work in a card reader in which the user inserts the entire banking card, such as the card readers at gas station pumps. The security sticker 20 generally has a thickness of approximately 17.5 to 18 thousandths inches.

Some banking cards have the account numbers 14 printed on the banking cards 10, but some account numbers 14 are embossed on the card 10. The embossed numbers 14 protrude from the surface of the front side of the card 10. A security sticker 20 made of a thin layer of covering material may not properly cover the protruding numbers, because the numbers can still be seen or printed without removing the thin layer of covering material. In one embodiment, the security sticker 20 has three layers as shown in FIG. 5.

FIG. 5 shows a banking card 51 covered by a three-layer security sticker 50 on the front side of the card 51. The three-layer security sticker 50 has a predetermined thickness that provides cushioning to deter the protruding embossed number from being seen or etched through the sticker 50, yet thin enough to be utilized in any credit card scanning device. An adhesive layer 52 is in immediate contact with the top side of card 51 and adheres to the relevant banking account information. This adhesive layer 52, when removed from the card 51, leaves a residue on the card 51 as an indication to the cardholder that the sticker 50 has been tampered with.

A cushion layer 54 is placed between the adhesive layer 52 and the top tamper evident layer 56. In one embodiment, the cushion layer 54 is made of tamper-evident metalized or foil material. The foil constitutes a cushion to prevent the protruding account numbers from being shown through the cushion or metalized layer 54 to prevent the disclosure of the covered embossed numbers without the removal of the security sticker 50. The cushion layer 54 and adhesive layer 52 may be of the type furnished by Flexcon Co., Inc. of Spencer, Mass. under the trademark TAMPERmark™, which leaves a checkerboard pattern on the surface of card 51 when layer 54 is tampered with. The combined layers 54 and 52 can also be of the type furnished by Avery Dennison Corp. under the brand name FASSON® tamper-evident film, as shown in the AVERY DENNISON "2013 Online Product Summary," and FASSON® "thermal transfer/durable/vinyl film" as shown in the AVERY DENNISON "Fasson EXACT Update," particularly FASSON 2 Mil Silver Void polyethylene terephthalate (PET) tetoron cotton (TC)/S8015/50#SCK, having a thickness ranging from 1 mil to 5 mils (0.001-0.005 inches) according to the Avery Dennison Corp. Fasson product specifications. Additionally, whenever the security sticker 50 is lifted from the card 51, the lifting movement always leaves crease markings in the coating in layer 54, thus also alerting the cardholder that the security sticker 50 has been tampered with.

In an additional embodiment of the present invention, the top layer 56 of the security sticker 50 is also a tamper evident layer that shows the cardholder the sticker has been tampered with. The material used in this top layer 56 can be standard chemical film that cracks itself when the sticker 50 is peeled. The cracking effect is created by the combination of the adhesive layer 52, the elastic layer 54, such as Kimdura by Avery Dennison Corp., and the chemical film in the top layer 56 working together, while still providing a security sticker 50 that generally has a thickness of approximately 17.5 to 18 thousandths inches. The crease marking on the elastic layer 54 and the cracking effect on the top layer 56 together combine to provide strong protection and alert the cardholder when their account information is potentially compromised. The cardholder may then immediately notify the banking card company that the card has been compromised. If desired, the sticker 50 can include both layers 54 and 56, or only one of layers 54 or 56.

Another embodiment of the present invention is used for the banking cards that have no embossed number, where the account number 14 is flat printed on the front of the card. The cushion layer 54 in this embodiment is thinner than the cushion layer 54 used in the previously described embodiment. The thinner metalized foil of layer 54 retains the attribute of having crease markings when peeled from the card 51.

FIG. 2 illustrates the security stickers 22, 26, 28, applied on the back of the banking card 10. Banking card frauds can happen when third parties obtain the cardholder's signature on the sales receipts and subsequently forging the signature. Even if the cardholder writes "check ID" on the signature line, a busy sales clerk does not recognize the handwritten instructions or mistakes it as the cardholder's signature when completing retail consumer transactions. In the present invention, a bold Check Photo ID reminder sticker 22 is applied over the signature block (not shown). The "[see] Photo ID" sticker 22 ensures that the cardholder's photo ID is checked each time the banking card is used during an in person transaction. The "Check Photo ID" security sticker 22 illustrated in this embodiment depicts salient graphics with typed wording that instructs the clerk to "See (e.g., graphic of an eye, stop sign, lock, etc.) CHECK PHOTO ID," which is glaringly obvious and should not be mistaken for a "signature."

The security code on the front or back of the card is protected through a specially designed security sticker 26 to conceal the three-digit security code on the backside of card 10 that states "DO NOT REMOVE." The stickers 22 and 26 are made of the same tamper evident material as sticker 20, described above and illustrated in FIG. 5. In an embodiment, the stickers 22 and 26 can be made without the cushion layer since they are used to cover printed rather than embossed information.

As seen in FIG. 2, the first twelve recessed numbers on the backside of an embossed banking card 10 are concealed with a sticker 28, made to the same specification of cushioned sticker 20, to prevent reading or tracing of the numbers while the card is being used outside the cardholder's presence. The structure of the covering sticker 28 is similar to the structure illustrated in FIG. 5. Three-layers of material are used to provide an alert when a clerk, waiter, etc., or other unauthorized user, attempts to tamper with the card. The predetermined thickness of the cushion layer 54 can vary based on the need to cover the recessed account numbers on the card 10 to prevent reading or etching the concealed number portion. In some embodiments, the cushion layer 54 of back covering sticker 28 may be thinner than the layer 54 used for the front covering sticker 20.

Figure 3A:
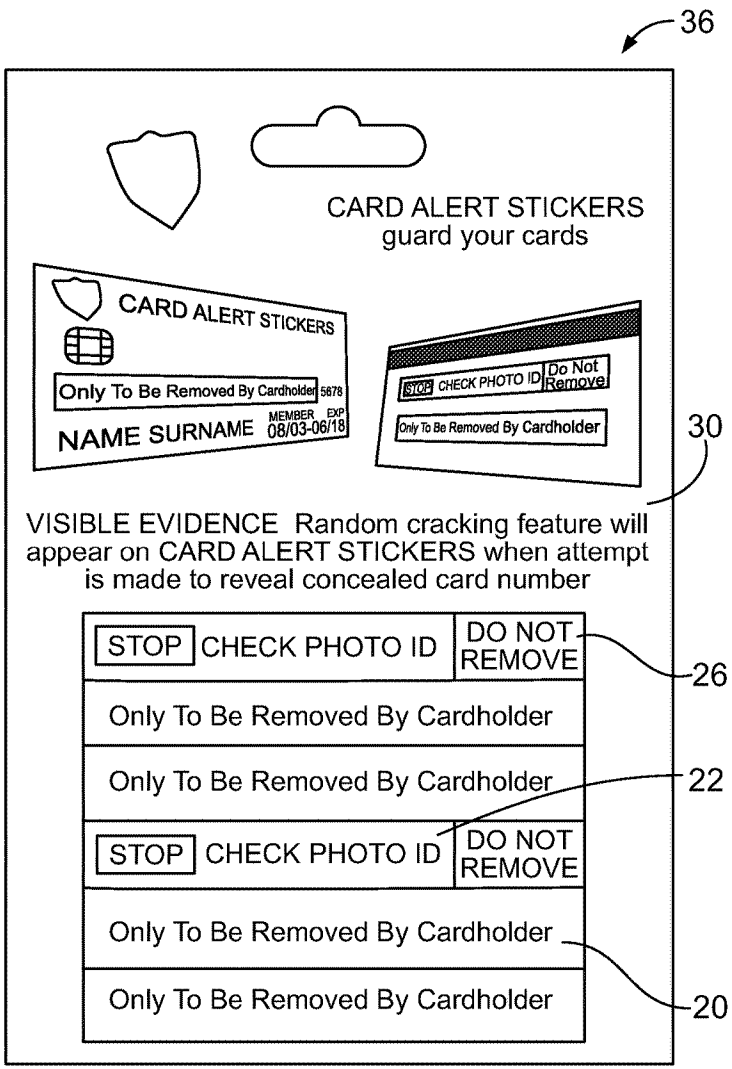
FIGS. 3*a*, 3*b*, and 3*c* are front elevation views of three embodiments of an adhesive security sticker kit having rectangular elements of three different sizes of removeable security stickers.
Figure 3C:
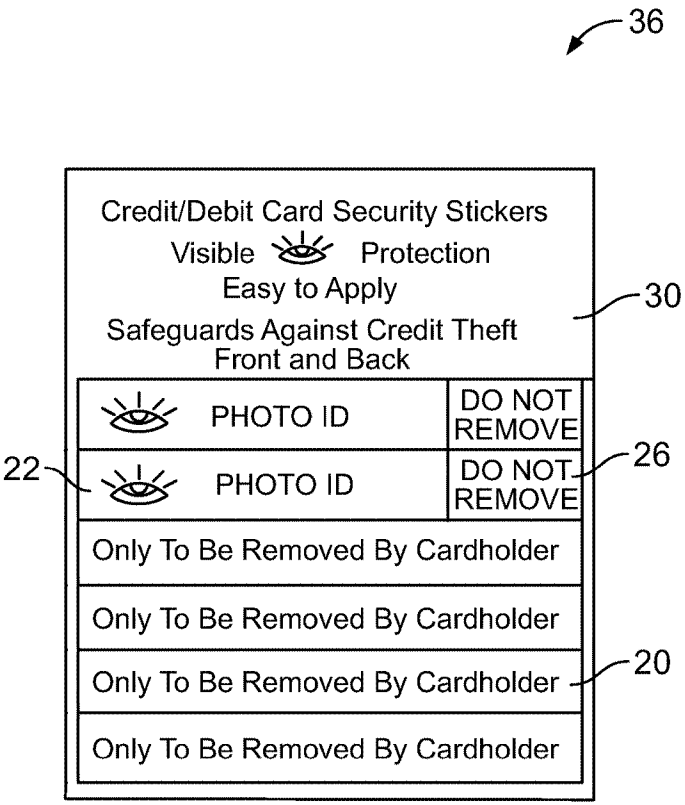
Figure 3B:
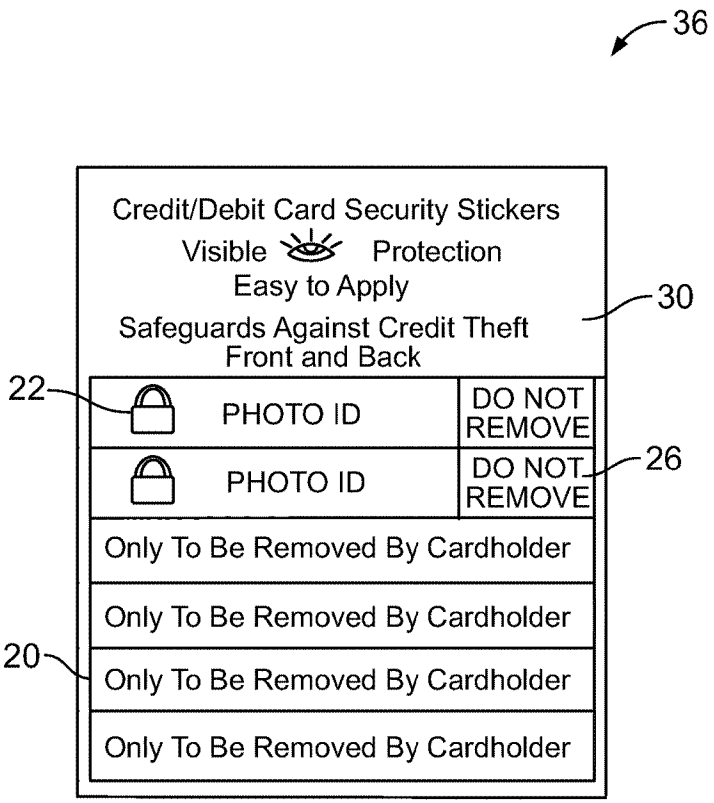

FIGS. 3*a*, 3*b*, and 3*c* depict front elevation views of three embodiments of the adhesive security sticker kit for the sale and distribution of the above mentioned security stickers to consumers. The upper substrate of all or some of the security stickers can carry indicia visible to the cardholder, such as instructions, advertisements, or unique designs of the user's choice. The information can be pre-printed on the stickers when they are sold to the consumers, or printing can be added by the consumer after the stickers are already purchased. The customized information makes it very hard to find a replacement sticker to replace on the card when the original security sticker is removed from the card. When the security sticker has a blank surface or uniform appearance, whoever removes the security sticker outside the presence of the cardholder can easily find an identical replacement of the security sticker and apply it back on the card to pretend the sticker has never been tampered with.

In the illustrated embodiment of the presently disclosed kit, two sets of covering stickers are provided in a package. Two signature-covering stickers 22, four security stickers 20 for the account numbers in the front and back of the card, and two card code number stickers 26 on a backing card 30 or a separate peelable backing are provided in the kit 36. The different stickers of the same kind provided in one kit may vary in thickness to accommodate the user's needs to properly protect the cardholder's personal information and banking card security. Each of the stickers 20, 22 and 26 have a thin film adhered to adhesive layer 52, which film has a peelable adhesive on the opposite surface of the thin film. In this manner, each sticker can be peeled from backing card 30 of kit 36 without creasing or cracking the film material 54 and/or 56.

Other types of banking cards use radio frequency identification technology (RFID) to transmit signals in transactions. In one embodiment of the present invention, a RF blocking material (not shown) is used in the sticker 50 to substantially cover both sides of the banking card to prevent remote access to the RFID signal. Dielectric material that is impervious to RF/electrical transmission may be used in the covering stickers. The dielectric may include plastic films, or plastic films coated with silver or iridium or similar materials known in the art.

FIG. 4 is a rear elevation view of one embodiment of an adhesive security sticker kit with instructions on the rear side of backing card 30 to apply the security stickers. The information includes the instructions to apply the stickers, and a disclaimer stating the product will not prevent all types of credit fraud or identity theft.

While several particular embodiments of security stickers for banking cards of the present invention have been shown and described, it will be apparent to those skilled in the art that changes and modifications may be made without departing from the true spirit and scope of the present invention.

We claim:

1. A security sticker for protecting information displayed on a banking card, comprising:

an adhesive layer adapted to make complete contact with the banking card and adhere to the information on the banking card, wherein a residue of the adhesive layer remains on the banking card even after the sticker has been removed from the banking card, said adhesive layer including a removable peeling backing adapted to protect the adhesive layer prior to contact with the banking card;

a substrate layer made of tamper-evident material selected from the group consisting of thermal transfer film, tamper-evident polyethylene terephthalate (PET) film, and durable vinyl film, the substrate layer adapted to conceal the security code on the banking card;

a top layer in communication with the substrate layer, the top layer comprising a chemical film adapted to crack and display a cracking visual effect when the security sticker is peeled from the banking card, the cracking effect created by the combination of the adhesive layer, the substrate layer, and the chemical film of the top layer working together; and the information retained by the banking card comprising the security sticker is configured to be functionally read within a card reading device.

2. The security sticker of claim 1, wherein the substrate layer includes the phrase "DO NOT REMOVE."

3. The security sticker of claim 1, wherein the top layer is tamper-evident.

4. The security sticker of claim 1, wherein the top layer includes a camouflaged surface.

5. The security sticker of claim 1, further comprising at least one of a radio frequency blocking material and a dielectric material that substantially covers both sides of the banking card adapted to prevent remote access to the banking card's radio frequency identification (RFID) signal.

6. The security sticker of claim 5, wherein the dielectric material includes one of a plastic film and a plastic film coated with one of silver and iridium.

7. A security sticker for protecting information displayed on a banking card, comprising:

an adhesive layer adapted to make complete contact with the banking card and adhere to the information on the banking card, wherein a residue of the adhesive layer remains on the banking card even after the sticker has been removed from the banking card, said adhesive layer including a removable peelable backing adapted to protect the adhesive layer prior to contact with the banking card;

a substrate layer made of tamper-evident material selected from the group consisting of thermal transfer film, tamper-evident polyethylene terephthalate (PET) film, and durable vinyl film, the substrate layer including at least one of salient graphic indicia and the phrase "CHECK PHOTO ID" adapted to alert a person to check for photo identification of the banking card user;

a top layer in communication with the substrate layer, the top layer comprising a chemical film adapted to crack and display a cracking visual effect when the security sticker is peeled from the banking card, the cracking effect created by the combination of the adhesive layer, the substrate layer, and the chemical film of the top layer working together; and the information retained by the banking card comprising the security sticker is configured to be functionally read within a card reading device.

8. The security sticker of claim 7, wherein the top layer is tamper-evident.

9. The security sticker of claim 7, wherein the top layer includes a camouflaged surface.

10. The security sticker of claim 7, further comprising at least one of a radio frequency blocking material and a dielectric material that substantially covers both sides of the banking card adapted to prevent remote access to the banking card's radio frequency identification (RFID) signal.

11. The security sticker of claim 10, wherein the dielectric material includes one of a plastic film and a plastic film coated with one of silver and iridium.

12. A security sticker for protecting information displayed on a banking card, comprising:

an adhesive layer adapted to make complete contact with the banking card and adhere to and conceal the information on the banking card, wherein a residue of the adhesive layer remains on the banking card even after the sticker has been removed from the banking card, said adhesive layer including a removable peelable backing adapted to protect the adhesive layer prior to contact with the banking card and no longer contact the security sticker once the removable peelable backing is removed;

a cushion layer in communication with the adhesive layer, the cushion layer comprising a material selected from the group consisting of thermal transfer film, tamper-evident polyethylene terephthalate (PET) film, and durable vinyl film and having a predetermined thickness, the material and the predetermined thickness adapted to provide a cushion that conceals embossed and recessed information on the banking card and prevents at least one of etching and retrieval of the embossed and recessed information on the banking card, the cushion layer including at least one first portion that includes depressions formed by the embossed information when the security sticker is applied to the banking card and at least one second portion that does not include depressions, the at least one second portion adjacent to the embossed information and adapted to conceal the embossed information;

a top tamper-evident layer in communication with the cushion layer; and the information retained by the banking card comprising the security sticker is configured to be functionally read within a card reading device.

13. The security sticker of claim 12, wherein the top tamper-evident layer includes one of a tamper-evident metalized material, a tamper-evident foil material, a tamper-evident plastic material, and a coating, said tamper-evident metalized material, tamper-evident foil material, tamper-evident plastic material and coating adapted to become marked with a plurality of crease markings when the security sticker is attempted to be removed from the banking card.

14. The security sticker of claim 13, wherein the one of the tamper-evident metalized material, the tamper-evident foil material, the tamper-evident plastic material, and the coating includes a cushion adapted to prevent embossed information from showing through at least one of the cushion layer, metalized material, foil material, plastic material, and coating.

15. The security sticker of claim 12, wherein the top tamper-evident layer includes at least one of a camouflaged surface and a chemical film, wherein the chemical film is adapted to crack and display a cracking visual effect when the security sticker is peeled from the banking card, said cracking effect created by the combination of the adhesive layer, cushion layer, and the chemical film of the top tamper-evident layer working together.

16. The security sticker of claim 12, wherein one of the adhesive layer and the cushion layer include at least one of pre-printed indicia and user-defined indicia.

17. The security sticker of claim 12, wherein the top tamper-evident layer includes at least one of pre-printed indicia and user-defined indicia.

18. The security sticker of claim 12, further comprising at least one of a radio frequency blocking material and a dielectric material that substantially covers both sides of the banking card adapted to prevent remote access to the banking card's radio frequency identification (RFID) signal.

19. The security sticker of claim 18, wherein the dielectric material includes one of a plastic film and a plastic film coated with one of silver and iridium.

20. The security sticker of claim 12, wherein the security sticker has a thickness of approximately 0.017 inches when the removable peelable backing has been removed and the predetermined thickness of the cushion layer is between 0.0037 and 0.004 inches thick.

* * * * *